US005579093A

United States Patent [19]

Wagner et al.

[11] Patent Number: 5,579,093

[45] Date of Patent: Nov. 26, 1996

[54] RESILIENTLY BIASED END CAPS FOR PHOTOCONDUCTIVE DRUMS

[75] Inventors: Moritz P. Wagner, Walworth; William A. Hammond, Rochester; Eugene A. Swain, Webster, all of N.Y.

[73] Assignee: Xerox Corporation, Stamford, Conn.

[21] Appl. No.: 483,000

[22] Filed: Jun. 7, 1995

[51] Int. Cl.[6] ..... G03G 5/00

[52] U.S. Cl. ..... 355/211; 355/200

[58] Field of Search ..... 355/200, 210, 355/211, 212, 213, 245; 492/27, 45, 47; 403/26, 83, 88

[56] References Cited

U.S. PATENT DOCUMENTS

| | | | |
|---|---|---|---|
| 2,891,301 | 6/1959 | Conklin . | |
| 3,695,757 | 10/1972 | Gregory | 355/200 |
| 3,994,053 | 11/1976 | Hunt . | |
| 4,040,157 | 8/1977 | Shanly . | |
| 4,105,345 | 8/1978 | Van Wagner | 403/24 |
| 4,120,576 | 10/1978 | Babish . | |
| 4,134,669 | 1/1979 | Reitner | 355/211 X |
| 4,400,077 | 8/1983 | Kozuka et al. . | |
| 4,561,763 | 12/1985 | Basch | 355/3 DR |
| 4,621,919 | 11/1986 | Nitanda et al. | 355/3 DR |
| 4,878,085 | 10/1989 | Ward et al. | 355/47 |
| 5,151,737 | 9/1992 | Johnson et al. | 355/211 |
| 5,357,321 | 10/1994 | Stenzel et al. | 355/211 |
| 5,461,464 | 10/1995 | Swain | 355/211 |
| 5,465,138 | 11/1995 | Jaskowiak et al. | 355/245 |

OTHER PUBLICATIONS

U.S. Patent Application Serial No. 08/358,436; Filed Dec. 19, 1994; entitled "Segmented End Roll"; by David J. Maty.

*Primary Examiner*—Sandra L. Brase
*Attorney, Agent, or Firm*—John S. Wagley

[57] ABSTRACT

A hub for supporting a tube is provided. The hub includes an expandable body adapted to be mounted at least partially in the tube and a resilient urging member. The urging member has at least a portion of the urging member internal to the body to expand the body so that a portion of the body contacts the tube.

24 Claims, 6 Drawing Sheets

RESILIENTLY BIASED END CAPS FOR PHOTOCONDUCTIVE DRUMS

The present invention relates to photoconductive drums used in electrophotographic printing machines. More particularly, the invention relates to end caps mounted in the photoconductive drum.

Cross reference is made to the following application filed concurrently herewith: U. S. application Ser. No. (D/08/485,080), entitled "Glueless Flange for Rigid Photoreceptors", by Ismael R. Sanchez et al.

A photoconductive member is a cylindrical or belt-like substrate used in an electrophotographic printing machine. A substrate is coated with one or more layers of a photoconductive material, i.e., a material whose electrical conductivity changes upon illumination. The photoconductive member includes, for example, an aluminum cylinder having a thin layer of a photoconductive organic compound thereon. In electrophotographic printing, an electrical potential is applied across the photoconductive layer and then exposed to light of an image. The electrical potential of the photoconductive layer decays at the portions irradiated by the light, leaving a distribution of electrostatic charge corresponding to the dark areas of the projected image. The electrostatic latent image is made visible by development with a suitable powder.

With the development of more advanced, high speed electrophotographic copiers and printers, stringent requirements have been placed on these complex imaging systems including long operating life with minimum maintenance. For example, the supporting substrate must meet precise tolerance standards and adhere well to photoconductive insulative layers applied thereto. Generally, the aluminum drums utilized as a support substrate are relatively expensive and often require replacement due to wear prior to the need to replace the photoconductive insulating layer. For example, rapid wear, sometimes referred to as "ring gouge", is caused by spacing shoes riding on the surface of the ends of the aluminum drums. Moreover, reconditioning of the aluminum drums, including lathing and polishing is a necessary prerequisite to prepare the substrate to receive a coating of the photoconductive layer or layers. Moreover, aluminum drums may necessarily be thick in order to achieve adequate rigidity to meet the stringent tolerance requirements. Heavy drums, however, require more powerful drive systems and rugged clutches to overcome high inertia characteristics.

The precise tolerance requirements of current reproduction machines means low photoconductive drum radial runout. Damage to the drum during handling can deform the drum and counterbore resulting in an out of tolerance condition when the drum is fitted within support hubs. A slight cock in the drum assembly can throw the shaft support bearing off center and this can be magnified by the weight of a heavy drum. Control of drum runout is particularly important for magnetic brush development systems in which drum tolerance directly affects the spacing between the drum and magnetic brush roller applications.

Attempts to reduce radial runout of drum have been varied. Typically, the end cap has an outer diameter which is in sliding engagement with an internal lip on the photoconductive drum. Both the hub diameter and the drum inner diameter require close tolerances and low runout to assure the required low assembly runout.

In U.S. Pat. No. 4,561,763 to Basch, the drum support hub included a flexible collet which fitted between the inner diameter of the drum and an internal lip on the hub. The resilient fingers on the collet provided some alleviation in the tolerance in the required tolerances of the drum inner diameter and the hub counter bore. The collet was molded of a plastic material and consequently had only minimal gripping power to hold the hub to the photoreceptive drum, requiring still unacceptably close tolerances to maintain the hub assembly radial runout requirements.

Alternative designs of photoconductive drum end caps consist of a generally cylindrical drum having end caps with an outer diameter which is slidingly fitted within the bore of the drum. End caps are generally bonded to the drum with an adhesive. With this design, the drum inside diameter and the outer diameter of the hub require very close tolerances. Further, the use of adhesives may require a delay in the assembly process for the adhesive to cure prior to subsequent assembly.

In addition to assembling the drum with adhesive end caps, disposal and recycle of the drum having the adhesive is a further problem. During the recycling of the photoconductive drum assembly, the aluminum drum must be separated from the plastic end caps. The surfaces of the drum and end caps may be blemished during separation and adhesive particles may stick to the drum or the end caps. The end caps can break while trying to shear them out of the drum assembly. Furthermore, applying the adhesive to the inside of the drum and guaranteeing a solid bond between the drum and the end caps is not a simple matter.

The following disclosures may be relevant to various aspects of the present invention:

U.S. Pat. No. 5,357,321

Patentee: Stenzel et al.

Issue Date: Oct. 18, 1994

U.S. Pat. No. 5,151,737

Patentee: Johnson et al

Issue Date: Sep. 29, 1992

U.S. Pat. No. 4,878,085

Patentee: Ward et al.

Issue Date: Oct. 31, 1989

U.S. Pat. No. 4,621,919

Patentee: Nitanda et al.

Issue Date: Nov. 11, 1986

U.S. Pat. No. 4,561,763

Patentee: Basch

Issue Date: Dec. 31, 1985

U.S. Pat. No. 4,400,077

Patentee: Kozuka et al.

Issue Date: Aug. 23, 1983

U.S. Pat. No. 4,120,576

Patentee: Babish

Issue Date: Oct. 17, 1978

U.S. Pat No. 4,105,345

Patentee: Van Wagner

Issue Date: Aug. 8, 1978

U.S. Pat. No. 4,040,157

Patentee: Shanly

Issue Date: Aug. 9, 1977

U.S. Pat. No. 3,994,053

Patentee: Hunt

Issue Date: Nov. 30, 1976

The relevant portions of the foregoing disclosures may be briefly summarized as follows:

U.S. Pat. No. 5,357,321 to Stenzel et al. discloses a drum supporting hub including a disc shaped member having a circular periphery. A hole extends axially through the center of the disc shaped member and a long thin electrically conductive resilient s-shaped member is trapped between flared edges and an axle shaft and the ends of the s-shaped member contact the inner periphery of the disc shaped member.

U.S. Pat. No. 5,151,737 to Johnson et al. discloses a hollow cylindrical shell having an axial slit. Axial ribs extend inwardly from the shell. Conical wedges are fitted to the ends of the shell and the conical surface of the wedges contact chamfers on the ribs. A shaft is slidably fitted to an axial opening in the wedges. A nut on an end of the shaft is used to draw the wedges together causing the shell to expand.

U.S. Pat. No. 4,621,919 to Nitanda et al. discloses a photoreceptive drum having a face integrally formed on one side of the drum. An integrally formed shaft extends from the integrally formed face.

U.S. Pat. No. 4,561,763 to Basch discloses a cylindrical drum assembly including a pair of drum supporting hubs positioned on the ends of a cylindrical drum. The hubs include an annular ring having resilient finger extending from the ring. An external recess on a disc shaped end plate fits inside the fingers while the inner periphery of the cylindrical drum fits outside the fingers. The fingers connect the drum to the plate.

U.S. Pat. No. 4,400,077 to Kozuka et al. discloses a photosensitive drum assembly having a cylindrical drum and two disc shaped flanges positioned on the ends of the drum. The flanges each include a lip which is closely fitted to the external periphery of the drum. Connecting rods interconnect the flanges.

U.S. Pat. No. 4, 120,576 to Babish discloses a drum support apparatus for supporting a cylindrical drum. The apparatus includes a pair of hubs each having a central stem. A shaft interconnects the hubs and has a loosely fitted tube over the shaft. The periphery of the stem fits with the inner periphery of the tube. Tabs on the shaft interconnect with a slot in the stem.

U.S. Pat. No. 4,105,345 to Van Wagner discloses a drum support assembly including a cylindrical drum having spaced apart internal grooves and a pair of hubs. The hubs each have four equally spaced radially sliding lock plates with an outer edge which matingly fits into the grooves. A centrally located shaft is secured to the hubs and interconnects them.

U.S. Pat. No. 4,040,157 to Shanly discloses a drum support assembly a cylindrical hub and two conical shaped hubs. The hubs include equally spaced lobes on the periphery of the hubs which mate with an internal periphery on the ends of the hub. A shaft is fitted to the center of the hubs and three equally spaced tie rods interconnect the hubs.

U.S. Pat. No. 3,994,053 to Hunt discloses a drum support assembly a cylindrical hub and two conical shaped hubs. The hubs include equally spaced lobes on the periphery of the hubs which mate with an internal periphery on the ends of the hub. A shaft is fitted to the center of the hubs and three equally spaced tie rods interconnect the hubs.

SUMMARY OF THE INVENTION

In accordance with one aspect of the present invention, there is provided a hub for supporting a tube. The hub includes an expandable body adapted to be mounted at least partially in the tube and a resilient urging member. The urging member has at least a portion of the urging member internal to the body to expand the body so that a portion of the body contacts the tube.

In accordance with another aspect of the present invention, there is provided a photoconductive member. The member includes a drum which has a photoconductive material coated on the drum and a hub for supporting a tube. The hub includes an expandable body adapted to be mounted at least partially in the tube and a resilient urging member. The urging member has at least a portion of the urging member internal to the body to expand the body so that a portion of the body contacts the tube.

In accordance with further aspect of the present invention, there is provided an electrophotographic printing machine of the type having a latent image recorded in a photoconductive drum. The improvement includes a drum which has a photoconductive material coated on the drum and a hub for supporting a tube. The hub includes an expandable body adapted to be mounted at least partially in the tube and a resilient urging member. The urging member has at least a portion of the urging member internal to the body to expand the body so that a portion of the body contacts the tube.

BRIEF DESCRIPTION OF THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 6:
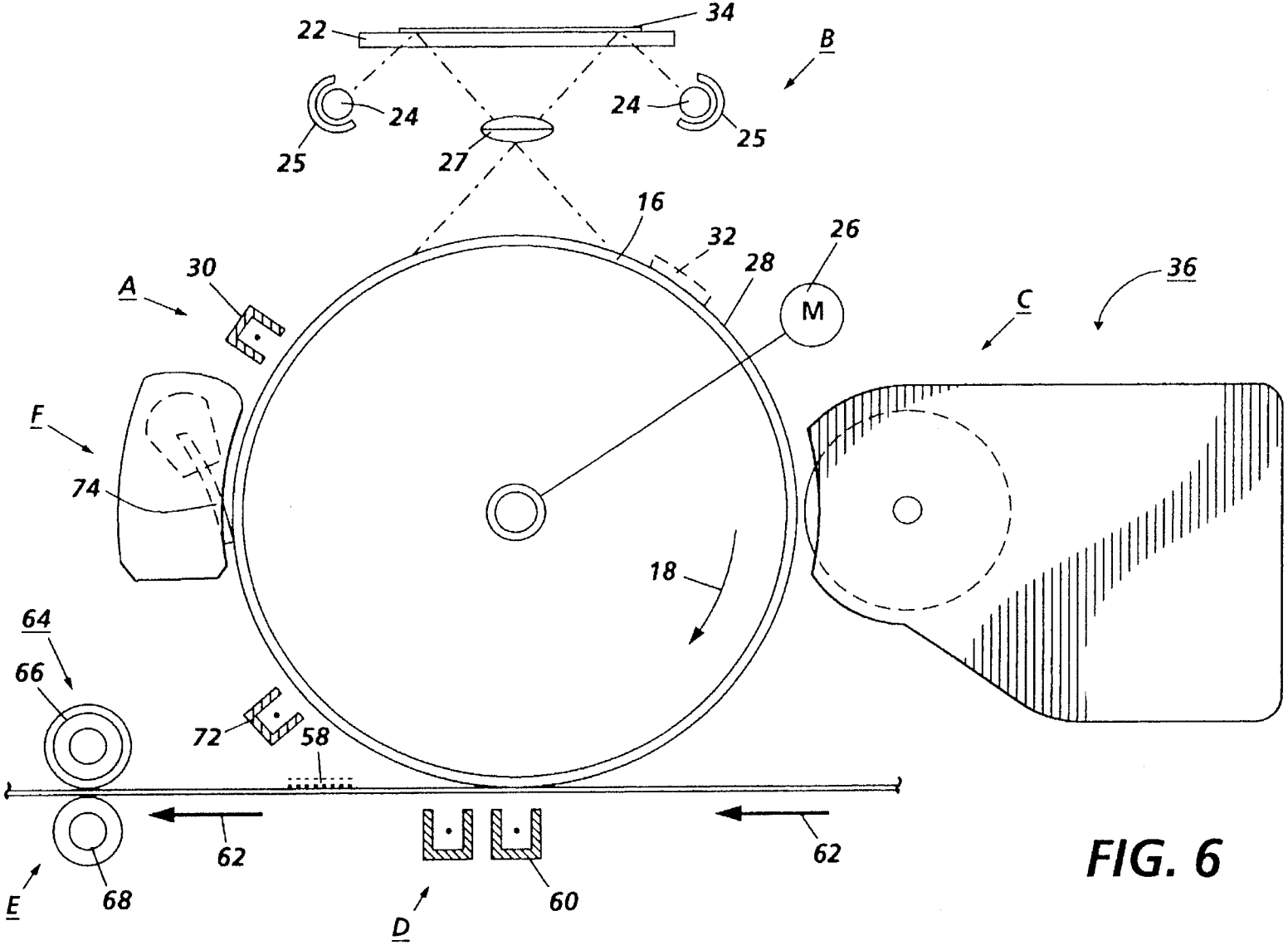
FIG. 6 is a schematic elevational view of an illustrative electrophotographic printing machine incorporating the hub of the present invention therein.

For a general understanding of the illustrative electrophotographic printing machine incorporating the features of the present invention therein, reference is made to the drawings. In the drawings, like reference numerals have been used throughout to designate identical elements. FIG. 6 schematically depicts the various components of an electrophotographic printing machine incorporating the corona discharge device of the present invention therein. Although the corona discharge device of the present invention is particularly well adapted for use in the illustrative printing machine, it will become evident that these corona discharge devices are equally well suited for use in a wide variety of uses and are not necessarily limited in their application to the particular embodiments shown herein.

Referring now to FIG. 6, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

A document 34 to be reproduced is placed on a platen 22, located at imaging station B, where it is illuminated in a known manner by a light source such as a lamp 24 with a photo spectral output matching the photo spectral sensitivity of the photoconductor. The document thus exposed is imaged onto the drum 16 by a system of mirrors 26 and lens 27, as shown. The optical image selectively discharges surface 28 of the drum 16 in an image configuration whereby an electrostatic latent image 32 of the original document is recorded on the drum 16 at the imaging station B.

At development station C, a development system or unit, indicated generally by the reference numeral 36 advances developer materials into contact with the electrostatic latent images. The developer unit 36 includes a device to advance developer material into contact with the latent image.

The developer unit 36, in the direction of movement of drum 16 as indicated by arrow 18, develops the charged image areas of the photoconductive surface 28. This developer unit contains black developer, for example, material 44 having a triboelectric charge such that the black toner is urged towards charged areas of the latent image by the electrostatic field existing between the photoconductive surface and the electrically biased developer rolls in the developer unit which are connected to bias power supply 42.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are removed at cleaning station F. The cleaning station F includes a blade 74.

It is believed that the foregoing description is sufficient for purposes of the present application to illustrate the general operation of an electrophotographic printing machine incorporating the development apparatus of the present invention therein.

Figure 1:
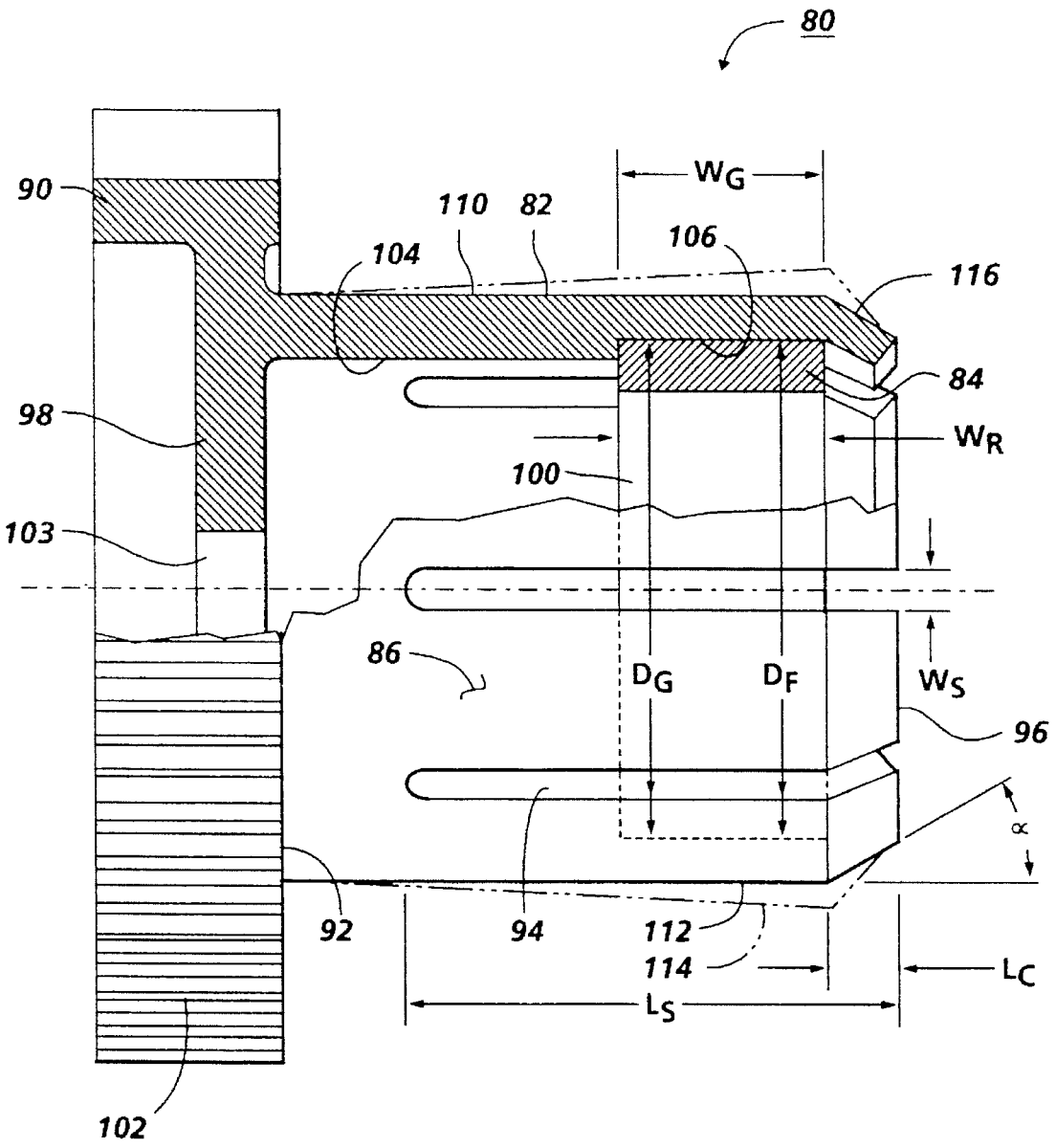
FIG. 1 is a plan view, partially in section, of a spring loaded hub according to the present invention.

According to the present invention and referring to FIG. 1, spring loaded end cap or hub 80 is shown. The end cap 80 includes an expandable body 82 and a resilient urging member 84 located at least partially inside the expandable body 82. The expandable body 82 includes at least a cylindrical portion 86 which is expandable. The expandable body 82 may also include a disk shaped portion 90 extending from a first end 92 of the cylindrical portion 86 of the expandable body 82. The cylindrical portion 86 has a generally tubular shape. The cylindrical portion 86 may be made of any suitable durable material and may be made of an expandable natural or synthetic material such as a rubber or synthetic rubber, but preferably is made of a material with limited ability to expand, such as a plastic, for example, polycarbonate. To provide the expanding capabilities of the cylindrical portion 86, voids or apertures in preferably the form of slots 94 extend axially from a second open end 96 of the cylindrical portion 86. The slots 94 are preferably made of a width $W_s$ and a length $L_s$ sufficient to provide the expanding capability necessary for the cylindrical portion 86. While the invention may be practiced with as few as one slit when using a generally non-expandable material, preferably a plurality, for example -8-, equally spaced apart slots 94 are spaced about the cylindrical portions 86.

The disk shaped portion 90 may be distinct from cylindrical portion 86, or preferably be molded integrally with the cylindrical portion 86. The disk shaped portion 90 is thus preferably molded of a plastic material, for example, filled polycarbonate, preferably the same material as the cylindrical portion 86. The disk shaped portion preferably includes a central cap portion 98 which serves to enclose the first end 92 of the cylindrical portion 86 and to prevent contamination from entering a cavity 100 formed within the cylindrical portion 86 of the expandable body 82.

To provide for driving the hub 80, preferably a gear 102 is located on the disk shaped portion 90. The gear 102 may be made of a separate material from the disk shaped portion 90, or as shown in FIG. 1 and as preferred, be integral with the disk shaped portion 90. The gear 102 may be any suitable force transmitting gear but preferably is a helical gear to provide for an axial bias to the hub 80.

The disk shaped portion 90 preferably provides for the positioning of the hub 80 and, as shown in FIG. 1, the disk shaped portion 90 includes a centrally located aperture 103 through which a shaft (not shown) may slidably fit to provide for the positioning of the hub 80.

The resilient urging member 84 may be any suitable member capable of exerting a radially outward force on inner periphery 104 of the cylindrical portion 86 of the expandable body 82. As shown in FIG. 1, the resilient urging member 84 is in the form of a spring. The spring 84 is placed in the cavity 100 of the cylindrical portion 86 of the hub 80 and is positioned in a compressible position within the cylindrical portion 86 such that a portion of the member 84 applies a force against the inner periphery 104 of the cylindrical portion 86.

For example, the resilient urging member 84 may be in the form of a split ring made of a resilient material, for example, spring steel. An internal groove 106 may be formed in the inner periphery 104 of the cylindrical portion 86. The internal groove 106 has a width $W_G$ which is slightly larger than the width $W_R$ of the ring 84. The internal groove 106 serves to contain the ring 84 within the cylindrical portion 86. The ring 84 has a free unassembled diameter $D_F$ which is slightly larger than the inner diameter $D_G$ of the groove. Therefore, when installed into the internal groove 106, the ring 84 exerts a radially outward force on the inner periphery 104 the cylindrical portion 86 of the expandable body 82 causing outer periphery 110 of the cylindrical portion 86 to expand from a first unstrained position 112 when the ring has not been inserted to a second expanded position 114 upon insertion of the ring 14.

Figure 2:
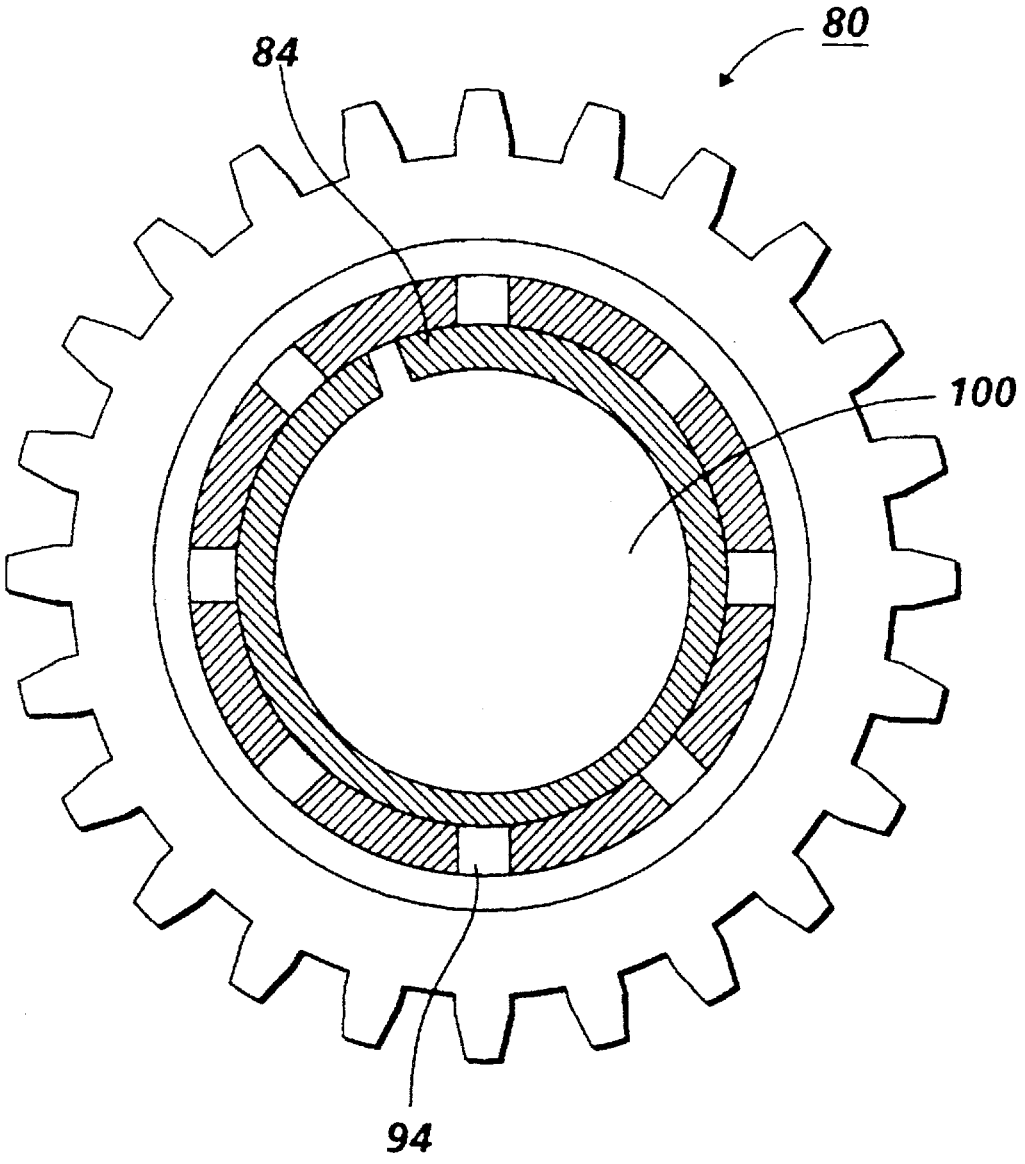
FIG. 2 is an end view, partially in section, of the hub of FIG. 1.

Referring now to FIG. 2, the eight slots 94 are shown equally spaced about the cylindrical portion 86 of the expandable body 82. The ring 84 is shown located in the internal groove 106 of the expandable body 82.

Figure 3:
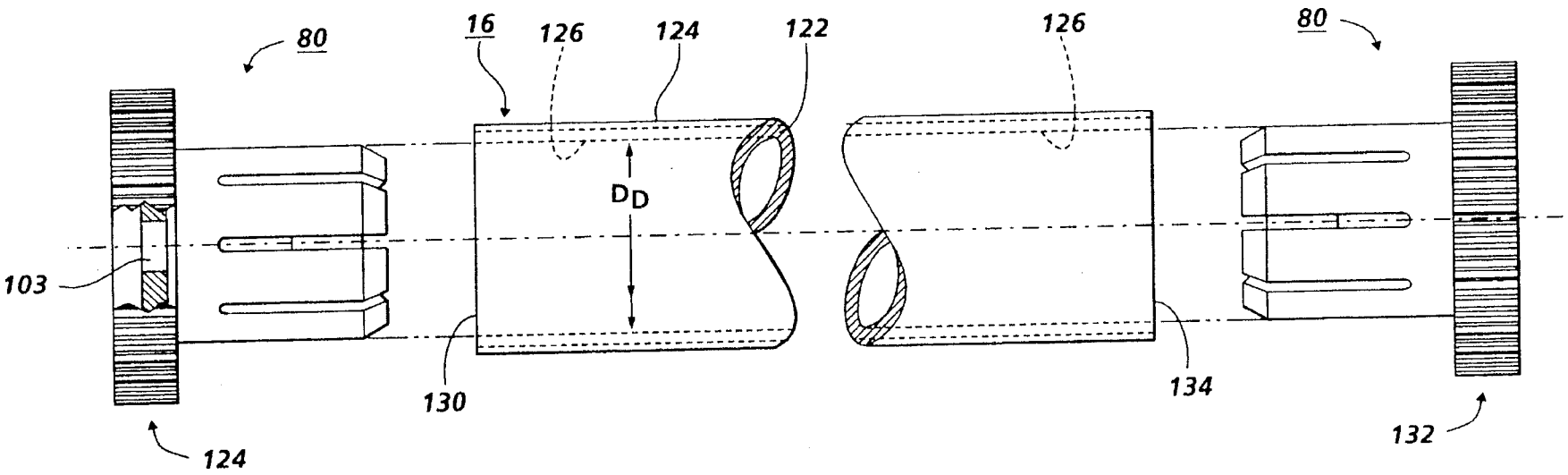
FIG. 3 is a plan view, partially in section, of a drum assembly utilizing the hub of FIG. 1.

Referring now to FIG. 3, two hubs 80 are shown installed within the photosensitive drum 16. The drum 16 typically includes a cylindrical substrate 120 typically made of aluminum upon which a photosensitive material 122 is applied. A first hub 124 is fitted into the inner periphery 126 of the drum 16 at first end 130 of the drum 16 while a second hub 132 is fitted into the inner periphery 126 at a second end 134 of the drum 16.

To assist in the assembly of the hub 80 into the drum 16, preferably, a chamfer 136 is located between the second end 96 of the cylindrical portion 86 and the outer periphery 110 of the cylindrical portion 86. A chamfer 116 has a length $L_C$ and an entry angle $\alpha$ sufficient to provide for an efficient and damage free insertion of the hubs 80 into the drum 16. The hubs 80 have a hub diameter $D_H$ with the ring 84 installed within the hub 80 which is slightly larger than the inner diameter $D_D$ of the drum 16 in order to secure the hubs 80 to the drum 16.

In order to provide a sufficient coefficient of friction between the inner periphery 126 of the drum and the outer periphery 110 of the hub 80, the surface roughness of the outer periphery 110 and the inner periphery 126 should be accurately controlled. Preferably, the drum 16 is machined to a controlled finish. Molding the hub 80 should provide the outer periphery 110 of the hub 80 with an accurate surface finish to obtain the required coefficient of friction. To enhance friction between the inner periphery 126 and the outer periphery 110, one may coat the outer periphery 110 with a friction enhancing material, i.e. elastomer, or a friction enhancing ring may be inserted between the inner periphery 126 and the outer periphery 110.

Figure 4:
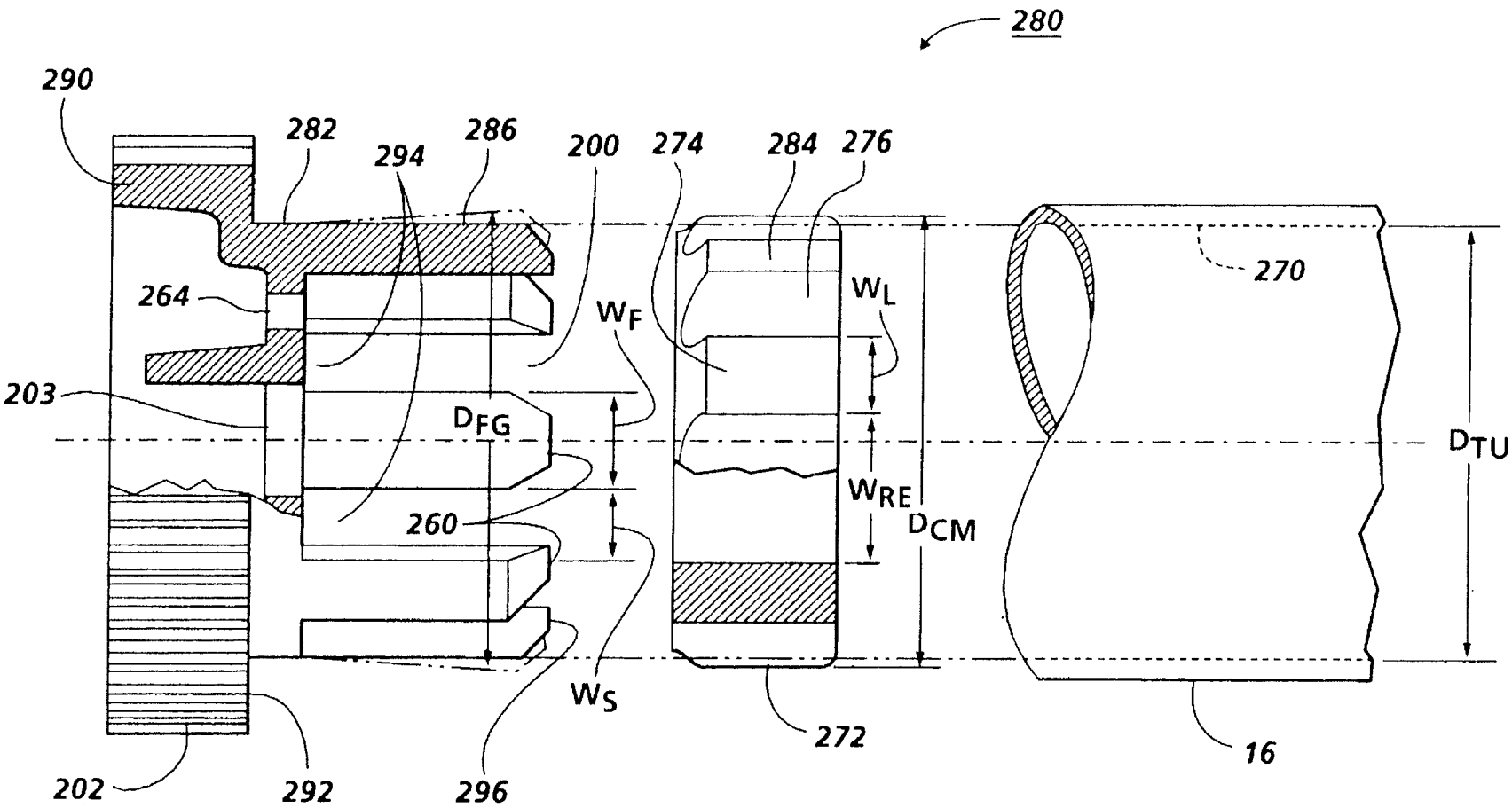
FIG. 4 is an exploded plan view, partially in section, of an alternate embodiment of a spring loaded hub according to the present invention.
Figure 5:
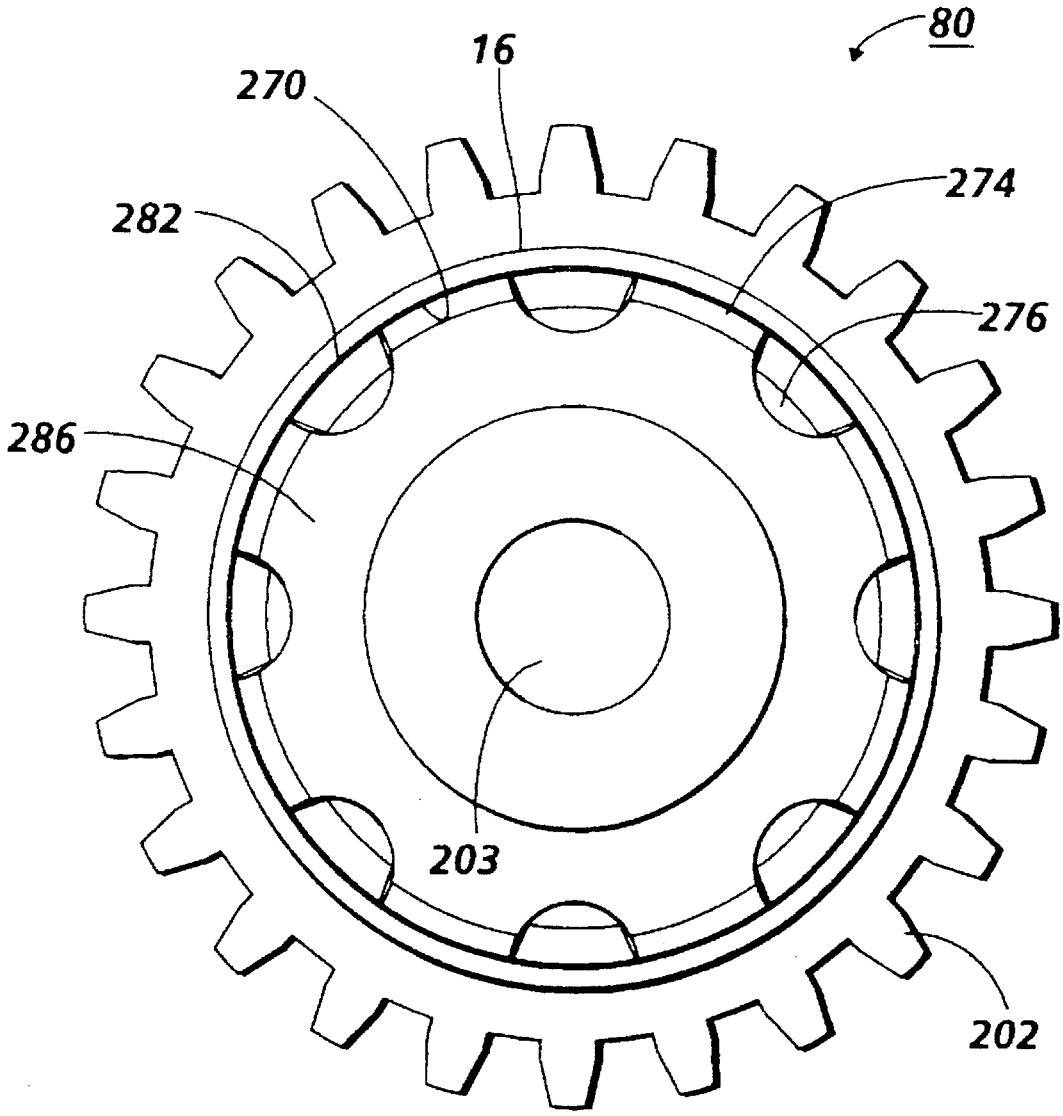
FIG. 5 is an end view, partially in section, of the hub of FIG. 4.

An alternate embodiment of a spring loaded end capper hub is shown as hub 280 in FIGS. 4 and 5. The hub 280 includes an expandable body 282 which is similar to expandable body 82 of end cap 80 and a resilient urging member 284 which is similar to urging member 84 of end cap 80. The compressible urging member 284 is located at least partially inside the expandable body 282. The expandable body 282 includes a cylindrical portion 286 which is expandable. The expandable body may also include a disk shaped portion 290 which extends from a first end 292 of the cylindrical portion 286 of expandable body 282. The cylindrical portion 286 has a generally tubular shape somewhat similar to that of cylindrical portion 86 of end cap 80. The cylindrical portion 286 may be made of any suitable durable material and may be made of an expandable natural or synthetic material such as rubber or synthetic rubber, but preferably is made of a material with limited ability to expand, such as a plastic, for example, polycarbonate. To provide the expanding capabilities of the cylindrical portion 86, openings preferably in the form of slots 294 extend axially from a second open end 296 of the cylindrical portion 86, similarly to cylindrical portion 86 of end cap 80. The slots 294, however, have a width $W_S$ which is significantly wider than the slots 94 of end cap 80. Fingers 260 are thus formed between adjacent slots 294. The slots 294 preferably are made with a width $W_{SL}$ and a length $L_{SL}$ sufficient to provide for the expanding capacity necessary for the cylindrical portion 286. The fingers 260 have a width $W_S$ which is approximately equal to the width $W_{SL}$ of the slots 294. While the invention may be practiced with as few as one slot, similar to end cap 80, when using a generally non-expandable material, preferably, a plurality, for example, 8 equally spaced apart slots 294 are used.

The expandable body 286 also includes a cylindrically shaped portion 290 which is similar to cylindrical shaped portion 90 of end cap 80. The cylindrical shaped portion 290 includes a central aperture or opening 203 which is similar to opening 103 of end cap 80. The disk shaped portion 290 also includes a gear 202 similar to gear 102 of end cap 80, except that gear 202 as shown is a spur gear, although a helical gear as in gear 102 of end cap 80 may likewise be suitable for the practice of the invention. The disk shaped portion 290 preferably includes at least one opening 264 which extends axially through the hub 280.

The resilient urging member 284, unlike the resilient urging member 84 of the end cap 80, is made of a compressible material. For example, the urging member 84 may be made of an elastomer, for example, synthetic rubber. The urging member 284 may have any suitable shape, but is typically in the form of a ring. The ring 284 is placed in cavity 200 of the cylindrical portion 286 of the end cap 280. The compressible urging member 284 includes lands 274 which extend radially outwardly from the member 284. Recesses 276 are formed between adjacent lands 274.

When inserting the compressible urging member 284 to the expandable body 282, the member 284 is so aligned such that lands 274 are in line with slots 294 and the recesses 276 are in line with fingers 260. The lands 274 upon insertion of the urging member 284 are located in the slots 294 while the fingers 260 are located in the recesses 276. The lands 274 have a width $W_L$ which is slightly smaller than the width $W_{SL}$ of the slots while the recesses 276 have a width $W_{RE}$ which is slightly larger than the width $W_S$ of the fingers 260. Upon installation of the urging member 284 in the body 282, the outer periphery 272 of the urging member 284 has a diameter $D_{CM}$ which is slightly larger than the diameter $D_{FG}$ of the fingers 260 of the body 282.

When the urging member 284 is inserted into the body 282, the member 284 at the recesses 286 interferes and extends outwardly the fingers 260 to provide for a $D_{FG}$ which when expanded is larger than diameter $D_{TU}$ of the inner periphery 270 of the drum 16. The urging member 284 thus upon insertion into the expandable body 286 and thereafter into the inner periphery 270 of the drum 16 causes both the lands 274 of the member 284 as well as the fingers 260 of the body 282 to interfere and hold against the inner periphery 270.

The openings 264 which may be a single opening but preferably are four equally spaced openings are designed in the end cap 280 so that a mounting tool can push directly through the body 282 and onto the urging member 284 to avoid spring back of the body 282 during assembly.

By having lands 274 of the urging member 284 contact the inner periphery 270 of the drum 16, the inherently higher coefficient of friction and better grip between the lands 274 and the inner periphery 270 reduces the need to tightly control the surface finish of the inner periphery 270 of the drum 16 as well as the surface condition of the expandable body 282.

Slight out of roundness of the urging member 284 and the expandable body 282 do not affect the out of roundness of the drum 16 as much as the ring 84 of the end cap 80.

The elastomer material of the member 284 provides a higher degree of friction on the aluminum compared to the body 82 of the end cap 80. The higher friction for the end cap 280 permits the reduction of interference between the urging member 284 and the drum 16 resulting in reduced pressure on the drum 16 and reduced flaring of the drum 16.

The spring biased hub of the present invention provides for easy insertion and removal of the hubs as well as a simplified assembly and disassembly process.

The spring bias against the internal periphery of the expandable hub provides for a transmission of torque over a wide range of temperatures as well as a self compensation for differences in the thermal expansion coefficients of the different materials.

The use of an internal spring pressing against an expandable hub provides for wider tolerances since the design compensates for the gap between the end cap and the metal tube.

The absence of an adhesive in the hub 80 eliminates the use of potentially hazardous chemicals and provides for easy and simple disassembly of the ring from the hub and for an inexpensive and simple remanufacture of the hub 80.

The use of an expandable hub minimizes the runout of the drum and permits improved printer copy quality.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A hub for supporting a tube, comprising:

an expandable body adapted to be mounted at least partially in the tube; and a radially expandable urging member having at least a portion thereof internal to said body to expand said body so that a portion therein contacts the tube.

2. The apparatus of claim 1, wherein said body comprises a cylinder defining a cavity therein.

3. The apparatus of claim 2, wherein said cylinder defines a plurality of slots therein.

4. A hub for supporting a tube, comprising:

an expandable cylinder defining a cavity therein adapted to be mounted at least partially in the tube; and a spring having at least a portion thereof internal to said cylinder to expand said cylinder so that a portion therein contacts the tube.

5. The apparatus of claim 4, wherein said spring comprises a split ring.

6. The apparatus of claim 4, wherein said cylinder defines a circumferential internal groove in an inner periphery of said cylinder, with said spring being mounted in the groove.

7. The apparatus of claim 4, wherein said spring comprises a compressible material.

8. The apparatus of claim 7, wherein said spring comprises a portion thereof external to said cylinder for contact with the tube.

9. A photoconductive member, comprising:

a drum having a photoconductive material coated thereon; and a hub for supporting a tube, said hub including an expandable body adapted to be mounted at least partially in the tube and a radially expandable urging member having at least a portion thereof internal to said body to expand said body so that a portion therein contacts the tube.

10. The member of claim 9, wherein said body comprises a cylinder defining a cavity therein.

11. The member of claim 10, wherein said cylinder defines a plurality of slots therein.

12. A photoconductive member, comprising:

a drum having a photoconductive material coated thereon; and a hub for supporting a tube, said hub including an expandable cylinder defining a cavity therein adapted to be mounted at least partially in the tube and a spring having at least a portion thereof internal to said cylinder to expand said cylinder so that a portion therein contacts the tube.

13. The member of claim 12, wherein said spring comprises a split ring.

14. The member of claim 12, wherein said cylinder defines a circumferential internal groove in an inner periphery of said cylinder, with said spring being mounted in the groove.

15. The member of claim 12, wherein said spring comprises a compressible material.

16. The member of claim 15, wherein said spring comprises a portion thereof external to said cylinder and in contact with said drum.

17. An electrophotographic printing machine of the type having a latent image recorded in a photoconductive drum, wherein the improvement comprises:

a drum having a photoconductive material coated thereon; and a hub for supporting a tube, said hub including an expandable body adapted to be mounted at least partially in the tube and a radially expandable urging member having at least a portion thereof internal to said body to expand said body so that a portion therein contacts the tube.

18. The printing machine of claim 17, wherein said body comprises a cylinder defining a cavity therein.

19. The printing machine of claim 18, wherein said cylinder defines a plurality of slots therein.

20. An electrophotographic printing machine of the type having a latent image recorded in a photoconductive drum, wherein the improvement comprises:

a drum having a photoconductive material coated thereon; and a hub for supporting a tube, said hub including an expandable cylinder defining a cavity therein adapted to be mounted at least partially in the tube and a spring having at least a portion thereof internal to said cylinder to expand said cylinder so that a portion therein contacts the tube.

21. The printing machine of claim 20, wherein said spring comprises a split ring.

22. The printing machine of claim 20, wherein said cylinder defines a circumferential internal groove in an inner periphery of said cylinder, with said spring being mounted in the groove.

23. The printing machine of claim 20, wherein said spring comprises a compressible material.

24. The printing machine of claim 23, wherein said spring comprises a portion thereof external to said cylinder and in contact with said drum.

* * * * *